US009218919B2

(12) United States Patent
Connell

(10) Patent No.: US 9,218,919 B2
(45) Date of Patent: Dec. 22, 2015

(54) ELECTRICAL CONTACTOR

(71) Applicant: Johnson Electric S.A., Murten (CH)

(72) Inventor: Richard Anthony Connell, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/327,965

(22) Filed: Jul. 10, 2014

(65) Prior Publication Data

US 2015/0015348 A1 Jan. 15, 2015

(30) Foreign Application Priority Data

Jul. 11, 2013 (GB) ..... 1312463.1

(51) Int. Cl.
*H01H 67/02* (2006.01)
*H01H 3/00* (2006.01)

(52) U.S. Cl.
CPC ..... *H01H 3/001* (2013.01)

(58) Field of Classification Search
CPC ..... H01R 13/64; H01H 50/54; H02B 1/42
USPC ..... 335/132
See application file for complete search history.

(56) References Cited

U.S. PATENT DOCUMENTS 3,324,431 A * 6/1967 Kussy et al. ..... 335/132
4,712,079 A * 12/1987 Marquardt ..... 335/132
5,075,604 A * 12/1991 Crook et al. ..... 318/17
6,623,276 B2 * 9/2003 Dalmau Ferrerfabrega et al. ..... 439/39
7,833,034 B2 * 11/2010 Connell ..... 439/251
8,658,921 B2 * 2/2014 Therrien et al. ..... 200/52 R
2009/0318000 A1 * 12/2009 Connell ..... 439/251
2010/0282579 A1 * 11/2010 Brown et al. ..... 200/271
2013/0178086 A1 * 7/2013 Connell ..... 439/251
2015/0015349 A1 * 1/2015 Connell ..... 335/15

FOREIGN PATENT DOCUMENTS

| | | |
|---|---|---|
| DE | 305257 | 3/1915 |
| GB | 936142 | 9/1963 |
| GB | 2001802 | 2/1979 |
| GB | 2413703 | 2/2005 |
| WO | WO 2010/129829 | 11/2010 |

* cited by examiner

*Primary Examiner* — Shawki S Ismail
*Assistant Examiner* — Lisa Homza
(74) *Attorney, Agent, or Firm* — Muncy, Geissler, Olds & Lowe, P.C.

(57) ABSTRACT

An electrical contactor has a pair of first terminals and a pair of second terminals. Each first terminal has a fixed member with at least one fixed electrical contact facing the other fixed member. The second terminals having back-to-back electrically-conductive movable arms with an electrically-insulating partitioning element there between. Each second terminal is associated with a different one of the first terminals, and has a movable electrical contact on the associated movable arm which faces the corresponding fixed contact. When the contacts close, contra-flowing current through the back-to-back movable arms produces a repulsive force between the movable arms increasing a force between the fixed and movable contacts.

22 Claims, 5 Drawing Sheets

ELECTRICAL CONTACTOR

CROSS REFERENCE TO RELATED APPLICATIONS

This non-provisional patent application claims priority under 35 U.S.C. §119(a) from Patent Application No. 1312463.1, filed in the United Kingdom on Jul. 11, 2013, the entire contents of which are hereby incorporated by reference.

FIELD OF THE INVENTION

The present invention relates to an electrical contactor, particularly but not necessarily exclusively for high-current switching contactors employed in modern electricity meters, so-called 'smart meters', for performing a load-disconnect function at normal domestic supply mains voltages, typically being 100 V AC to 250 V AC.

The invention may also relate to an electrical contactor of a high current switch which may be subjected to a high short-circuit fault condition requiring the contacts to not weld.

This invention therefore also relates to a two-pole electrical contactor, a single-phase electrical contactor for Live and Neutral feeds, a method of preventing or limiting electrical contact deflection on contact closure, and to a method of improving contact closure through preventing or limiting rotational clamping.

BACKGROUND OF THE INVENTION

In a fault condition with welded contacts, the electrical contactor provides 'free' un-metered electricity to a premises. A dangerous shock hazard can also occur if the Load, that is thought to be disconnected safely, is still live at mains voltage.

Many known electrical contactors are capable of satisfactorily switching nominal current at around 100 Amps or 200 Amps for a large number of Load-switching cycles. The switching is undertaken by special silver-alloy contacts containing certain additives which prevent welding. The switching blades or arms are configured to be easily actuated for the switching function, with minimal self-heating losses at the nominal currents concerned.

Most electricity meter specifications not only stipulate satisfactory nominal-current endurance switching lifetimes without the contacts welding, but also demand that at moderate short-circuit fault conditions they must also not weld, and must open on the next actuator-driven pulse. At much higher related 'dead-short' conditions, the switch contacts may weld, but must remain intact. In other words, there must be no explosion or emission of any dangerous molten material during the 'dead-short' duration, until protective fuses rupture or circuit breakers drop-out and safely disconnect the supply to the Load. This short-circuit withstand duration must be for a maximum of six cycles of the AC mains supply.

In North American electricity metering, domestic 2-phase supplies are fed via a three-wire cable from a heavy-duty street-side utility transformer to the metered premises at 115 V AC per phase, being 180 degrees apart, with-respect-to a central Neutral/Earth connection. For moderate loads at 115 V AC, each metered phase is fed via ring-main wiring to distributed sockets in the premises. However, all power-hungry loads such as washing machines, clothes driers, space heaters, pool heaters and air-conditioners, for example, are connected across both phases at 230 V AC, with a maximum Load capability of 200 Amps. Therefore, a robust 200 Amps two-pole contactor is required within the meter for performing the Load-disconnect function, as and when demanded.

In Europe and a majority of other territories worldwide, the dominant supply is single-phase 220 V AC at 100 Amps, and more recently 120 Amps, in compliance with the IEC 62055-31 specification. In North America and a few other countries using an equivalent system, the supply is two-phase 230 V AC at 200 Amps. This latter case is governed mainly by the ANSI C12.1 metering specification. Safety aspects are covered by other related specifications, such as UL 508, ANSI C37.90.1, IEC 68-2-6, IEC 68-2-27, IEC 801.3.

It is known from British patent 2413703 to BLP Components Limited of Newmarket, United Kingdom, to provide a bi-blade arrangement of parallel movable spring copper blades having inwardly facing movable contacts opposing a corresponding outwardly facing fixed contact. Opposing pairs of the spring copper blades are aligned with each other across the fixed contacts. In a basic 100 Amp switch, two spring copper blades and two fixed contacts are utilised, resulting in a total of four contacts with 50 Amps flowing in each parallel blade.

In a second higher nominal-current embodiment, constituting a 200 Amp switch, each spring copper blade is subdivided into two sprung sub-blades having a movable contact at each end. Each sub-blade is provided as part of a pair aligned and opposing each other across a fixed terminal member therebetween carrying associated fixed contacts. Each switch therefore has eight contacts, and a two-pole 2-phase Load-disconnect contactor therefore comprises sixteen contacts in total.

Such current sharing between blades significantly reduce contact repulsion forces for more reliable switching, minimal self-heating, and non-welding at the higher Nominal and short-circuit currents.

A problem associated with the higher current 200 Amp two-pole meter Load-disconnect contactor is the number of blades and contacts required. The increased number of blades necessitates a higher quantity of electrically conductive metal, in this case copper, and the increased number of contacts requires a greater silver content. This increases manufacturing costs substantially.

The known 100 Amp switch design from GB2413703 using simple parallel spring copper bi-blades is limited by the geometries and gap between each facing blade in the bi-blade set. Each bi-blade pair is capable of generating a certain magnetic attraction force at high shared current, one with-respect-to the other, balanced and acting against the contact repulsion forces. This ensures that the contacts remain closed during short-circuit faults. It is extremely difficult to configure the bi-blade pair to correctly balance the ratio of forces for a particular configuration, and given the limited space within the contactor casing. For the high current 200 Amp switch design, it was therefore convenient to utilise opposing aligned sub-blade pairs to achieve the desired switching characteristics.

SUMMARY OF THE INVENTION

Hence there is a desire for an electrical contactor which provides greater closing force on the contacts during high current or fault conditions.

Accordingly, in one aspect thereof, the present invention provides an electrical contactor comprising a pair of first terminals, each having a fixed member with at least one fixed electrical contact facing the other said fixed member; a pair of second terminals having back-to-back electrically-conductive movable arms with an electrically-insulating partitioning element therebetween; each second terminal being associated with a different one of the first terminals, and having a movable electrical contact on the associated movable arm which faces the corresponding fixed contact; the arrangement of the fixed members and the movable arms being such that, when the contacts close, contra-flowing current through the back-to-back movable arms produces a repulsive force therebetween which urges the movable arms away from each other, thereby increasing a force between the fixed and movable contacts.

Preferably, the contactor includes an actuating arrangement, wherein each movable arm includes a distal extension element extending distally of the movable contact and the actuating arrangement includes an urging member for outwardly biasing each distal extension element.

Preferably, each distal extension element is in-turned towards the partitioning element.

Preferably, the urging member includes a wedge-shaped element which is movable longitudinally of the movable arms and arranged to outwardly bias the distal extension elements so that the movable arms are urged towards the fixed members.

Preferably, the in use urging member counteracts inward distal rotation of the movable contacts due to the repulsive force which urges proximal portions of the movable arms away from each other when the contacts are closed.

Preferably, the actuating arrangement includes a separator member for separating the movable arms from their respective fixed members thereby opening the contacts.

Preferably, the separator member is movable from a first position at which it causes the contacts to open to a second position at which the movable arms are freely movable towards the fixed members.

Preferably, the separator member includes at least one elongate strut-like element proximally of the movable contacts.

Preferably, the actuating arrangement includes a carriage which is movable relative to the movable arms, the urging member and the separator member are disposed on the carriage whereby the movable contacts are interposed therebetween.

Preferably, the actuating arrangement further comprising a dual-latching electromagnetic actuator for moving the carriage to cause the contacts to close and open.

Preferably, each second terminal comprises at least two said movable arms at one side of the partitioning element aligned with at least two said movable arms at the other side of the partitioning element.

Preferably, the said at least two said movable arms comprise a narrow movable arm and a wide movable arm, the wide movable arm being pre-set to lead during closing of the contacts, and the narrow movable arm being pre-set to lag during closing of the contacts.

Preferably, the movable contact of the narrow movable arm is smaller than the movable contact of the wide movable arm.

Preferably, the contactor is a two-pole electrical contactor.

Alternatively, the contactor is a single-phase electrical contactor for Live and Neutral feeds.

According to a second aspect, the present invention provides a method of preventing or limiting electrical contact deflection on contact closure, the method comprising the step of providing a distal extension element distally of a movable electrical contact on opposing movable arms of an electrical contactor, and a movable biasing element which moves into a biasing position against each distal extension element when the movable electrical contacts close with associated fixed electrical contacts of the electrical contactor, whereby current contra-flowing through the movable arms produces a repulsive force therebetween which urges the movable arms away from each other proximally of the movable electrical contacts, the distal extension elements being distal of the movable electrical contacts thereby preventing or limiting contact deflection or bounce.

According to a third aspect, the present invention provides a method of improving contact closure through preventing or limiting rotational clamping, the method comprising the step of providing a distal extension element distally of a movable electrical contact on opposing movable arms of an electrical contactor, and a movable biasing element which moves into a biasing position against each distal extension element when the movable electrical contacts close with associated fixed electrical contacts of the electrical contactor, whereby current contra-flowing through the movable arms produces a repulsive force therebetween which urges the movable arms away from each other proximally of the movable electrical contacts, thereby tending to tilt the movable electrical contacts relative to the fixed electrical contacts, the distal extension elements being distal of the movable electrical contacts counteracting the tendency of the movable electrical contacts to tilt and thereby maintaining a parallel or substantially parallel engagement between the contacts.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
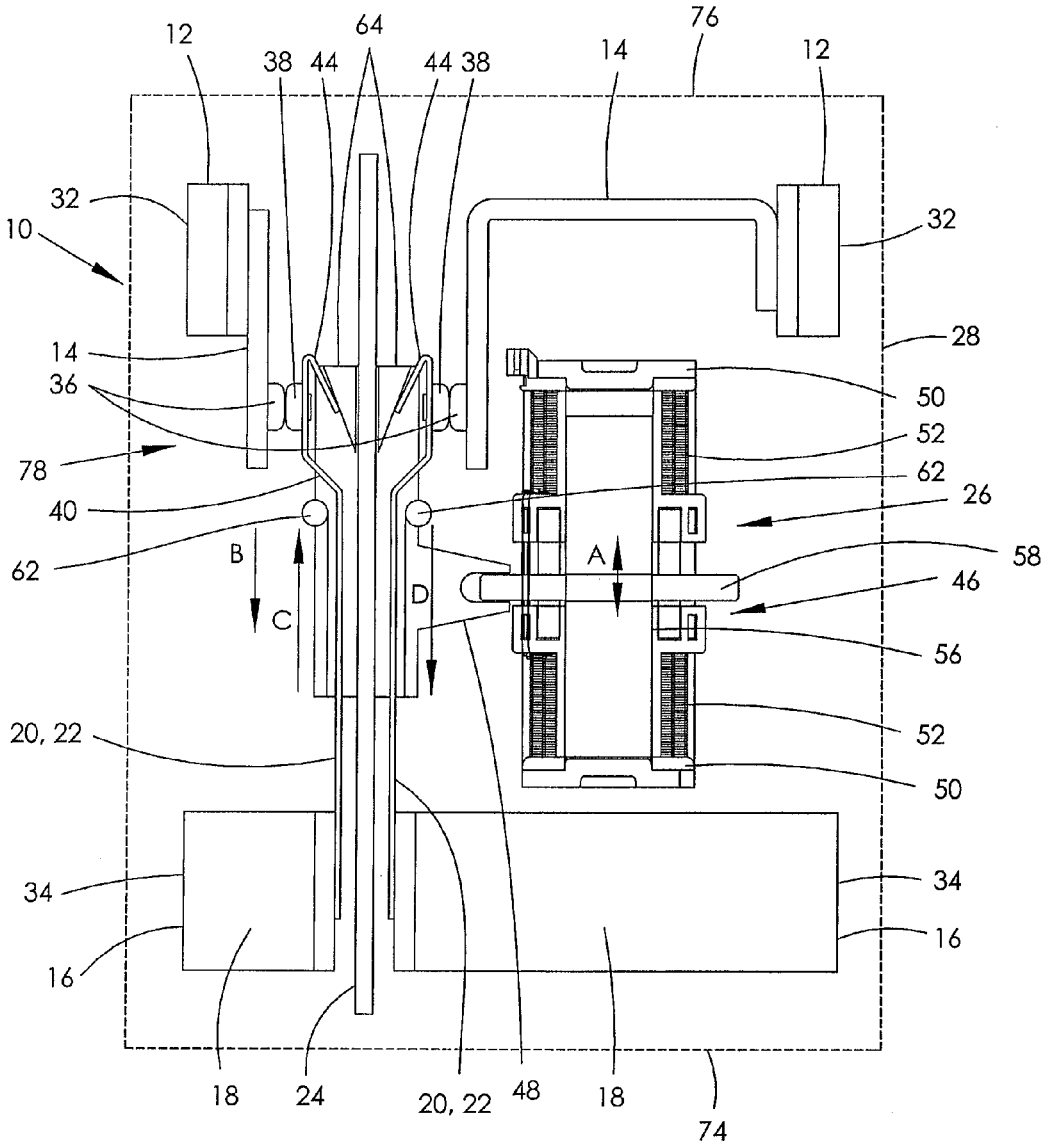
FIG. 1 shows a diagrammatic plan view of a first embodiment of a two-pole electrical contactor, in accordance with the present invention and shown with contacts closed.

Referring firstly to FIGS. 1 to 4 of the drawings, there is shown a first embodiment of a two-pole electrical contactor 10 which comprises two first terminals 12 each having facing fixed members 14 of electrically conductive material, two second terminals 16 each having a terminal body 18 from which a plurality of back-to-back cantilever movable arms 20, 22 also of electrically-conductive material extend, an electrically-insulating partitioning element 24 interposed between the back-to-back movable arms 20, 22, and an actuator arrangement 26 for, in this embodiment, simultaneously moving the movable arms 20, 22 relative to the fixed members 14.

The first and second terminals 12, 16 are mounted to a base 28 of a housing, which in the drawings is shown with its cover removed. A first terminal pad 32 of each first terminal 12 and a second terminal pad 34 of each second terminal 16 extend from opposite ends of the housing base 28 in spaced apart relationship.

The electrically-conductive fixed member 14 extends perpendicularly from a proximal end of the first terminal pad 32.

A plurality of fixed electrical contacts 36 is provided at or adjacent to a distal end of each fixed member 14. In this case, there is an odd number of fixed electrical contacts 36, being three. However, one, two or more than three fixed electrical contacts 36 can be utilised, as necessity dictates.

The fixed electrical contacts 36 of each first terminal 12 are inboard facing, so as to be aligned with and opposing their counterpart fixed electrical contacts 36 on the other first terminal 12.

Although the fixed members 14 are preferably formed of electrically-conductive material, such as a metal, for example, copper, the fixed members themselves may not be electrically conductive. As such, the fixed electrical contacts 36 may be fed by or feed a separate electrical conductor, such as a wire or cable, connected thereto.

The terminal body 18 of each second terminal 16 includes the second terminal pad 34 at or adjacent to its free distal end, and the electrically-conductive movable arms 20, 22, also known as blades, extend perpendicularly or substantially perpendicularly to the terminal body 18 preferably from its proximal end. In this case, the movable arms 20, 22 are engaged with the terminal body 18 at or adjacent to their proximal ends by riveting and/or brazing. However, the second terminal 16 could be formed as one-piece, or connection may take place by any other suitable engagement means.

There is an odd-number of the movable arms 20, 22, in this case being three, each having a movable electrical contact 38 partway there along and spaced from its free distal end. The number of movable arms 20, 22 matches the number of fixed electrical contacts 36. Therefore, one, two or more than three movable arms 20, 22 may be provided.

In this case, the movable contacts 38 are aligned with each other, as are the fixed contacts 36.

Each movable contact 38 is outboard or outwardly facing and positioned between the midpoint and the free distal end of its associated movable arm 20, 22. The movable contacts 38 of each movable arm 20, 22 are aligned not only with the corresponding movable contacts 38 of the other movable arms 20, 22 on the other second terminal 16, but are also arranged to face their corresponding fixed contacts 36.

In this embodiment, a pair of first said movable arms 20 and a second said movable arm 22 extend in parallel with each other towards an inboard side of the fixed member 14. Each of the first movable arms 20 has a lateral extent which is less than the lateral extent of the second movable arm 22. However, the longitudinal extents preferably match or substantially match.

The lateral extents of the first movable arms 20 are preferably the same or substantially the same, and the lateral extents may be uniform or substantially uniform along at least a majority of their respective longitudinal extents.

Preferably, the movable electrical contact 38*a* of the wider movable arm 22 is larger than the movable electrical contacts 38*b* of the pair of narrower movable arms 20.

Each movable arm 20, 22 is also substantially dog-legged, providing a ramped or sloped shoulder 40 partway along its length and proximally of the associated movable contact 38. A repulsive flexible portion 42 is therefore defined between the shoulder 40 and the proximal end of each movable arm 20, 22.

Although in some instances the movable arms may not necessarily be formed of electrically conductive material, such as copper for example, whereby the movable electrical contacts are fed by or feed separate electrical conductors, such as a wire or cable, in this embodiment it is required that a repulsive force be generatable between the opposing back-to-back movable arms 20, 22, and therefore it is preferred that the movable arms are electrically conductive.

Extending in a distal direction, and in this case forming an end portion of each movable arm 20, 22, is a distal extension element 44. The distal extension element 44 is preferably an elongate tang which may be conveniently angled inwardly away from the respective fixed member 14 and generally towards the partitioning element 24. A lateral extent of the distal extension element 44 may also be less than a lateral extent of each movable arm 20, 22 to enable optimization when counteracting induced flex caused by the repulsive flexible portions 42.

The actuator arrangement 26 preferably comprises a dual-latching electromagnetic solenoid actuator 46 and, also preferably, a slidable carriage 48 which may beneficially be formed of a low-friction polymer, for example. The dual-latching actuator 46 may beneficially include a two part actuator housing 50 having opposing spaced solenoid coils 52 therein, ferrite magnets in this case being plate magnets top and bottom, and a drivable plunger 56 carrying a drive arm or pin 58.

The actuator housing 50 is sized to fit tightly in an actuator compartment of the housing base 28 and an electrical input connector is preferably provided at one side to receive a corresponding electrical output connector from an electrical feed to the electrical contactor 10.

Advantageously, the solenoid actuator 46 may be located off-center on the housing base 28, as shown in the drawings. By extending one of the fixed members 14 and the associated second terminal pad 34, the slidable carriage 48 can be operated from one side. Again, this is beneficial in allowing the housing base 28 to be more compact, thus saving materials.

The slidable carriage 48 sits on the housing base 28 beneath the electrically-insulating partitioning element 24, which in this embodiment is preferably a wall sandwiched between the two movable arms 20, 22.

The carriage 48 includes a separating member 62 and an urging member 64. The separating member 62 is preferably formed of electrically insulative material, such as plastics, and in this case is an upstanding elongate strut-like element which is associated with each movable arm 20, 22 at either side of the partitioning element 24. Each strut-like element 62 is positioned to be engagable with a respective shoulder 40, thereby forcing the movable arms 20, 22 and therefore the electrical contacts 36, 38 apart to a predetermined gap.

Although the strut-like element 62 is preferably a pin or roller, any other suitable inward biasing means preferably carried by the carriage 48 may be utilised for opening the contacts 36, 38.

The urging member 64 in this case is an upstanding wedge element which the partitioning element 24 bisects. Each outwardly facing wedge face presents a sloped surface along which the inturned hook-shaped distal extension element 44 can slide as the carriage 48 is advanced and withdrawn.

With the carriage 48 in place, the drive pin 58 of the dual-latching actuator 46 is received in a pin opening formed in a protrusion 72 formed as part of a side wall of the carriage 48. The back-to-back movable arms 20, 22 extend over the carriage 48 along with the preferably uniformly continuous and unbroken partitioning element 24. Preferably, the movable arms 20, 22 and partitioning element 24 do not make contact with a base of the carriage 48, thereby reducing frictional forces when the carriage 48 is moved by the actuator 46.

By this arrangement, the inwardly facing fixed contacts 36 are collinearly or substantially collinearly aligned with the outwardly facing movable contacts 38, and are generally positioned in a common plane which is between or substantially between the separating member 62 and the urging member 64. The shoulders 40 oppose the separating member 62, and the distal extension elements 44 engage the ramped surfaces of the urging member 64.

Figure 4:
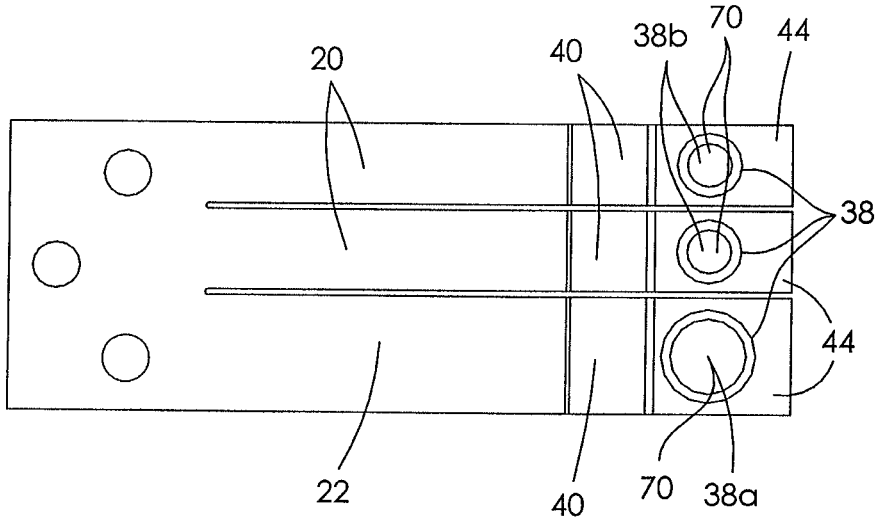
FIG. 4 is a contact-side view of movable arms of a terminal of the two-pole electrical contactor shown in FIG. 1.

With reference to FIG. 4, the current embodiment preferably utilises multiple movable contacts 38*a*, 38*b* for current sharing at nominal or high short-circuit fault levels. In this case, a single large movable contact 38*a* is provided on movable arm 22, and a small movable contact 38*b* is provided on each movable arm 20.

It is important that the contacts used have adequate top-lay silver-alloy thickness in order to withstand the arduous switching and carrying duties involved, thus reducing contact wear. The above-referenced prior art arrangement utilizing up to sixteen contacts has a silver-alloy top-lay thickness of an 8 mm diameter bi-metal contact in a range 0.65 mm to 1.0 mm. This results in a considerable silver cost.

Consequently, it is preferred that the electrical contactor 10 of the present invention utilizing groups of back-to-back movable arms 20, 22 in order to reduce a number of contacts 36, 38 incorporates a lead/lag switching procedure. In this arrangement, each wider single movable arm 22 of the set is designated as the switching lead arm, and the narrower pair of movable arms 20, which in an open contact condition are aligned to be coplanar or substantially coplanar with the wider single movable arm 22, is designated as the switching lag arms.

As such, the larger movable contact 38*a* of the single movable arm 22 may have a diameter of 8 mm with a silver top-lay in a region of 0.8 mm. However, the smaller movable contacts 38*b* of the pair of movable arms 20 may have diameters of 6 mm, providing the thermal mass of the movable arms 20, 22 is adequate, with a silver top-lay 70 in a region of 0.4 mm each. Since the switching lag arms 20 do not bear the brunt of the load current as the switch closes, wear is minimal and thus the top-lay material can be reduced without loss of performance or longevity.

To additionally address the issue of tack welding between contacts under high short-circuit loads, a particular compound top-lay 70 can be utilised, in this case enriching the silver alloy matrix with a tungsten-oxide additive. This may be particularly beneficial for the larger movable contact 38*a* of the switching lead arm 22.

Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding; the tungsten-oxide additive raises the general melt-pool temperature at the switching point, which again discourages tack-welding; and because the tungsten-oxide additive is a reasonable proportion of the total top-lay mass, for a given thickness, its use provides a cost saving.

Utilizing the urging member 64 and/or pre-loading of the movable arms 20, 22, the lead/lag switching procedure can be pre-set such that, during a pulse-drive of the dual-latching actuator 46, a defined fractional time delay is introduced between the closing of the movable contact 38*a* of the wider switching lead arm 22 with its fixed contact 36 and the closing of the movable contacts 38*b* of the pair of switching lag arms 20 with their respective fixed contacts 36.

In operation, the dual-latching actuator 46 is driven to a first latch position, indicated by arrow A in FIG. 1, towards a first terminal end 74 of the housing base 28, whereby the movable contacts 38 and fixed contacts 36 close, preferably utilizing the above-described lead/lag switching procedure. Due to the movable arms 20, 22 not being pre-loaded or inherently spring biased to close with their corresponding fixed contacts 36, movement of the carriage 48 causes the wedge-shaped urging member 64 to advance and thus urge the contacts 34, 36 closed. See FIG. 1 and arrow B.

In this invention, a first group of the movable arms 20, 22, being at a first side of the partitioning element 24, is arranged for current flow in a first direction, see arrow C, and a second group of the movable arms 20, 22, being at a second side of the partitioning element 24 and opposingly aligned with the first group, is arranged for current flow in a second direction which is opposite to the first direction, see arrow D. Consequently, repulsion occurs proximally of the movable contacts 38 at the repulsive flexible portions 42, causing outward bowing and thereby augmenting and thus enhancing a closure force at the closed contacts 36, 38.

Figure 3:
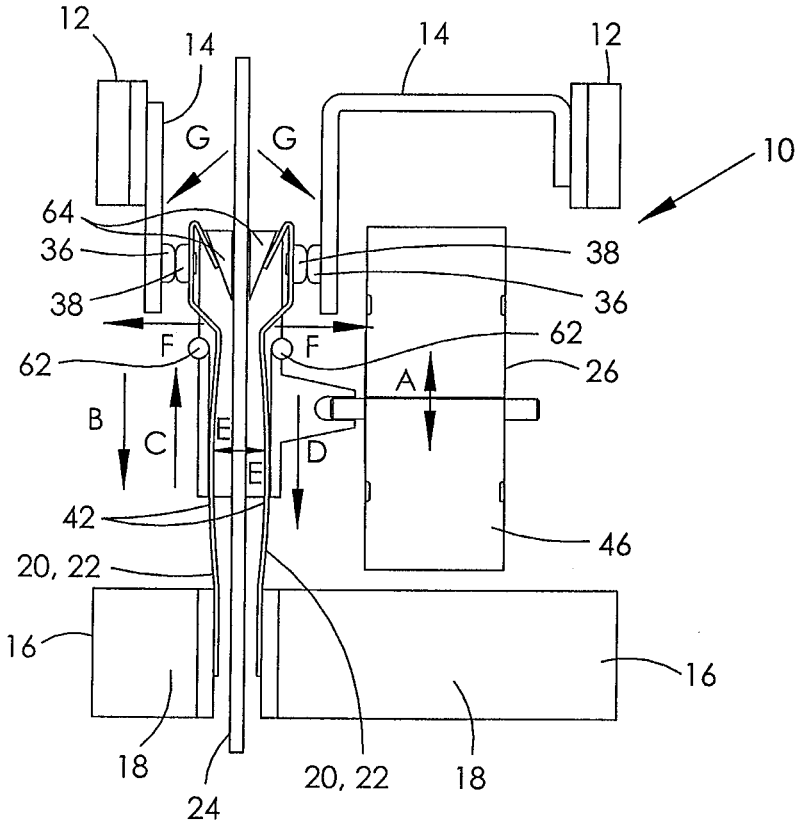
FIG. 3 is again a view similar to that of FIG. 1, but showing the two-pole electrical contactor in a moderate short-circuit or 'dead-short' fault condition.

However, as shown in FIG. 3, at a high shared short-circuit fault current, a significant repulsive magnetic force is generated at the flexible portions 42, see arrows E, causing greater outward bowing at the repulsive flexible portions 42 and therefore a much higher contact closing force. This repulsive force, due to the flex of the movable arms 20, 22, also potentially causes the movable contacts 38 to tilt proximally relative to the fixed contacts 36, see arrows F, thereby not providing parallel or uniform seating. To this end, the inturned distal extension elements 44 being positioned distally of the movable contacts 36 counter this rotational clamping effect by being braced against the urging member 64 to impart an outwards rotational force distally of the movable contacts 38, see arrows G.

Figure 2:
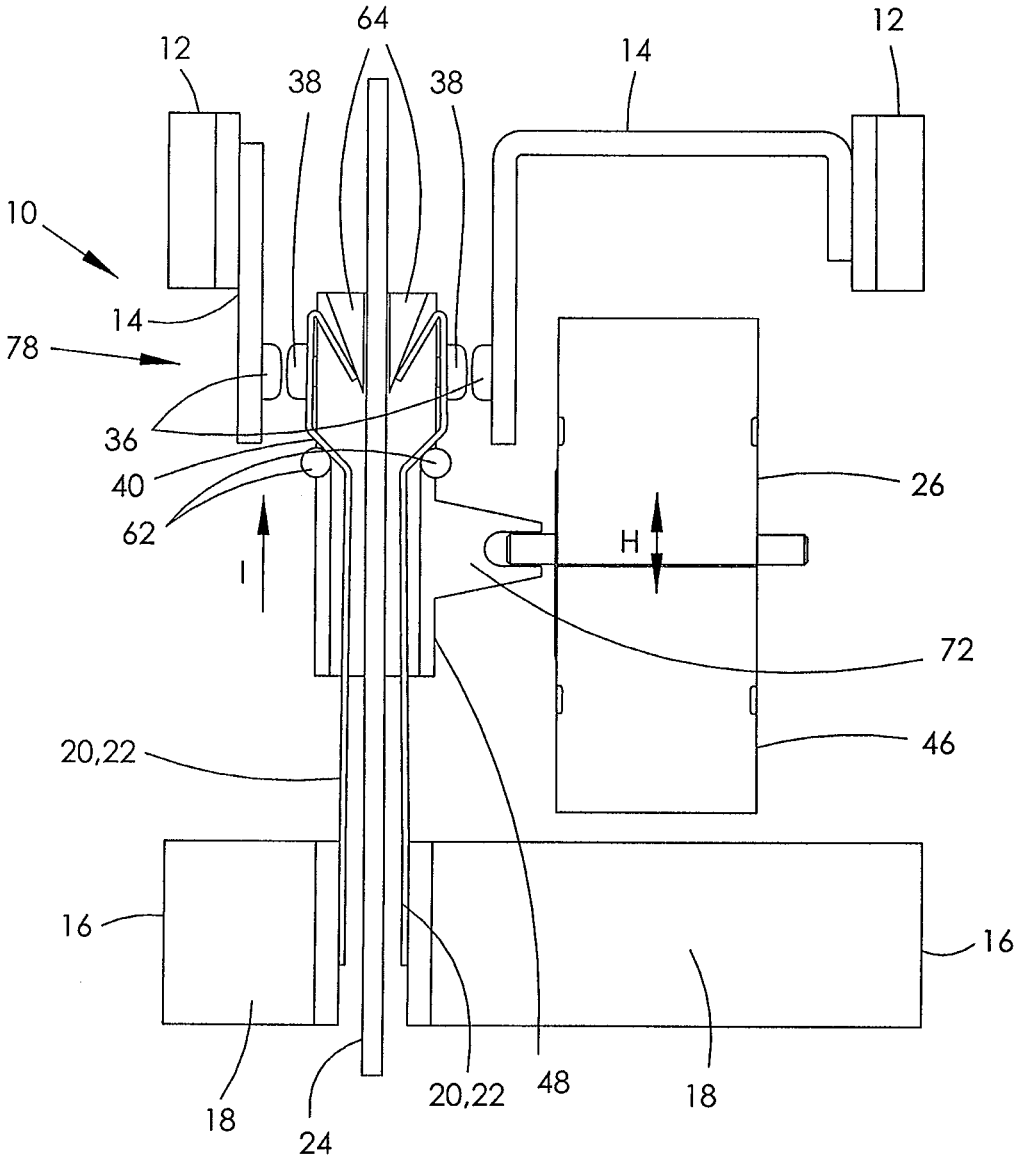
FIG. 2 is a view similar to that of FIG. 1, but showing the two-pole electrical contactor with its contacts open.

When the dual-latching actuator 46 is driven to a second latch position, indicated by arrow H in FIG. 2, towards a second terminal end 76 of the housing base 26, the carriage 48 slides causing the separating member 62 to advance into engagement with the shoulders 40 whilst withdrawing the urging member 64. See arrow I. This urges the movable arms 20, 22 back towards each other and the partitioning element 24, thus forcing the contacts 36, 38 apart.

The distal extension elements or tangs 44 are movable and braceable by the urging member 64 to prevent or limit the possibility of contact deflection during contact closure. This can be a particular issue if a short-circuit current is very high, for example, during AC peaks. Flexion of the movable arms 20, 22 at the repulsive flexible portions 42 may be great enough that the closing contact force causes the movable contacts 38 to rebound, bounce or deflect away from their respective fixed contacts 36. This can result in momentary opening of the switch with potentially catastrophic explosive consequences, along with the potential for causing tack-welds. The distal positioning of the urging member 64 allows the movable contacts 38 to be brought into positive and controlled engagement with the respective fixed contacts 36, and to positively retain the contacts 36, 38 in this closed condition. Longevity of the contact set 78, comprising the movable and fixed contacts 36, 38, is thus improved, with less likelihood of delamination of the contacts 36, 38.

In relation to the bi-blade prior art arrangement, the movable arms 20, 22 of the present invention can be shorter, narrower and thinner due at least in part to the use of the distal extension elements 44 and the associated separating member 62 and urging member 64. As such, a significant saving in electrically conductive material can be made over the prior art arrangement. Such movable arms 20, 22 also provide a lower nominal switch resistance in the region of 0.1 milliohm, which is typically half that of the bi-blade prior art arrangement.

Due to the use of the improved movable arms 20, 22 providing lower resistances, a material thickness of the terminal pads 32, 34 of the first and second terminals 12, 16 can be changed from a traditional tooled thicker blank of material to a thinner blank of material which is then folded to meet regulatory thickness requirements. This reduces a mass of electrically conductive metal, whilst still maintaining a required pad to pad resistance which is less than 0.2 milliohm.

The separating member 62 is preferably configured to open the movable arms 20, 22 to a pre-set contact gap in a preferred range of 0.6 mm to 1.0 mm, to meet a limiting open-contact voltage-breakdown requirement. The urging member 64 is preferably configured to impart a pre-set clamping force, preferably equal to or greater than 500 gF on each contact.

Figure 5:
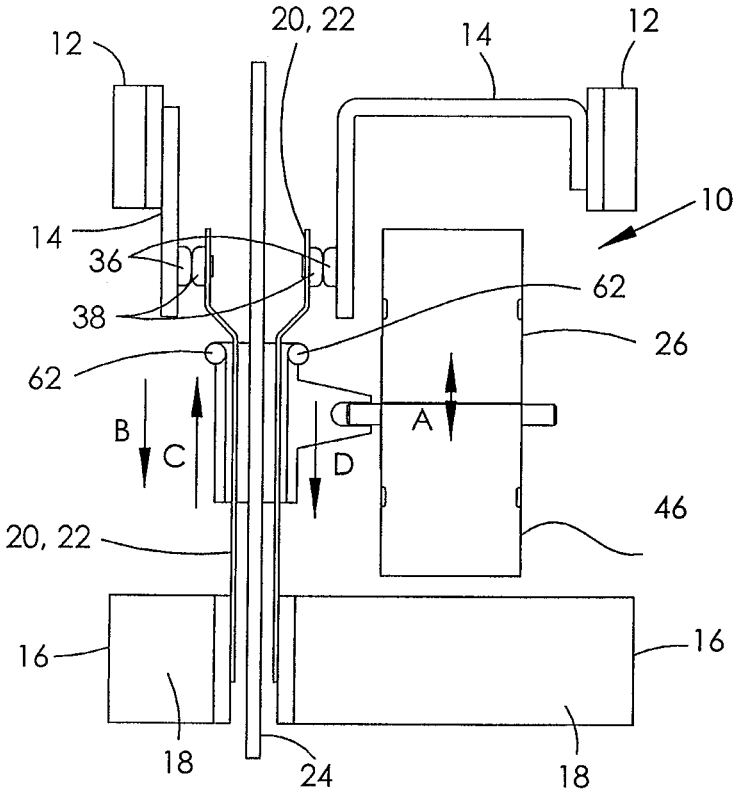
FIGS. 5 and 6 show diagrammatic plan views of a second embodiment of a two-pole electrical contactor, in accordance with the present invention and shown with contacts closed and open, respectively.
Figure 6:
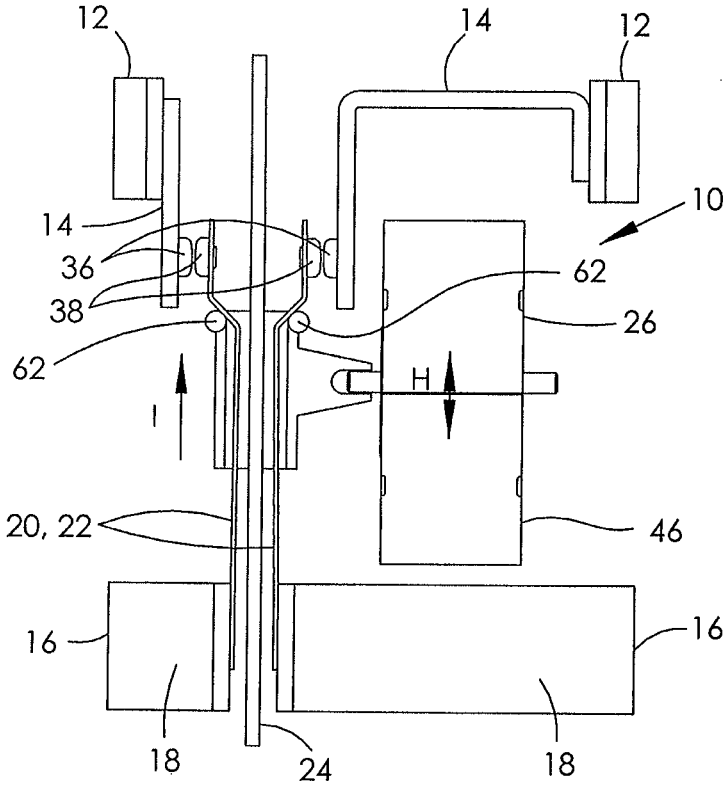

Referring now to FIGS. 5 and 6 of the drawings, there is shown a second embodiment of a two-pole two-terminal electrical contactor. Similar references are utilised for parts which are similar or identical to those of the first embodiment, and therefore further detailed description is omitted.

The electrical contactor 10 of this embodiment again comprises the two first terminals 12 having the fixed members 14, and the two second terminals 16 having the groups of back-to-back cantilever movable arms 20, 22. The upstanding electrically-insulating partitioning element 24 is also provided sandwiched between the opposing groups of movable arms 20, 22, along with the actuator arrangement 26 for moving the movable arms 20, 22 relative to the fixed members 14.

However, in this embodiment, the distal extension elements are dispensed with, and therefore consequently also the urging member. As such, the carriage 48 carries the separating member 62, whereby the partitioning element 24 and at least a portion of the movable arms 20, 22 extend over the base of the carriage 48, being interposed between the strut-like elements of the separating member 62.

The movable arms 20, 22 of each group may therefore be pre-formed and preloaded or prebiased to bias the associated movable electrical contacts 38 outwardly towards their respective fixed electrical contacts 36. As such, the movable contacts 38 engage with the fixed contacts 36 with a pre-set contact pressure in the absence of a force separating the movable arms 20, 22.

As can thus be understood from FIG. 5, the contacts are normally closed and the separating member 62 in conjunction with the shoulders 40 opens them. The contact pressure under normal loads is therefore determined by the pre-forming and preloading or prebiasing of the movable arms, along with the repulsive force generated by the contra-flowing current at the repulsive flexible portions 42. To this end, the electromagnetic actuator or other actuating means may only need to be a single-latching device. For example, a single drive coil and return spring arrangement could be utilised as part of the actuator, rather than twin spaced-apart drive coils as in the first embodiment.

Figure 7:
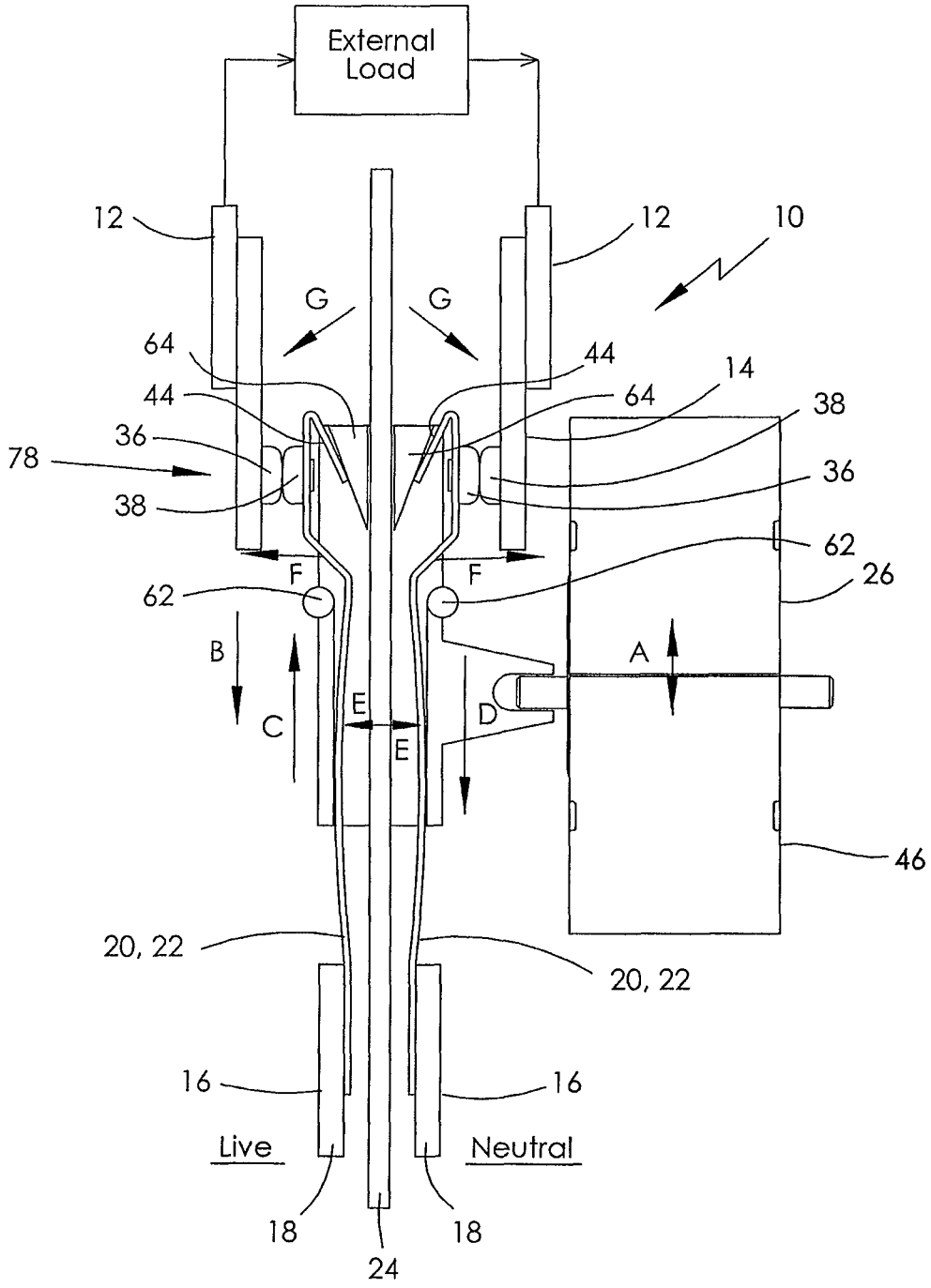
FIG. 7 shows a diagrammatic plan view of a third embodiment of a two-pole electrical contactor, in this case being in the form of a single-phase electrical contactor for Live and Neutral feeds and in accordance with the present invention.

Referring now to FIG. 7, there is shown a third embodiment of an electrical contactor. Again, similar references are utilised for parts which are similar or identical to those of the first embodiment, and therefore further detailed description is omitted.

The electrical contactor 10 of this embodiment is a single-phase electrical contactor for Live and Neutral feeds typically from a mains electricity supply, for example, in domestic and commercial premises. The single-phase electrical contactor comprises the two first terminals 12 having the fixed members 14 and communicating with an external load, and the two second terminals 16 having the groups of back-to-back cantilever movable arms 20, 22 and communicating with Live and Neutral electricity supply feeds. The upstanding electrically-insulating partitioning element 24 is again provided sandwiched between the opposing groups of movable arms 20, 22, along with the actuator arrangement 26 for moving the movable arms 20, 22 relative to the fixed members 14.

In this arrangement, the distal extension elements 44 are provide on the movable arms 20, 22 distally of the respective movable contacts 38, and the actuator-activated carriage 48 carries both the separating member 62 and the urging member 64, as in the first embodiment. However, it is feasible that, by pre-biasing the movable arms to a contacts closed position, the distal extension elements may be dispensed with and therefore also the urging member, as in the second embodiment. To this end, the contra-flowing current causing the flexible portions 42 to repel each other results in an increase in closing force between the fixed and movable contacts.

This single-phase electrical contactor for Live and Neutral feeds is particularly advantageous, in that the external load can be fully electrically isolated during a short-circuit disconnect.

The movable arms may or may not be pre-loaded to a contact open or closed condition. If pre-loaded to a contact closed condition, then the separating member positively biases the movable arms away from each other when the contacts are open. If pre-loaded to a contact open condition, then the urging member positively biases the movable arms away from each other to increase a force between the closed contacts.

Although the distal end extensions are preferably directed inwardly away from the fixed member and towards the partitioning element, the distal end extensions may be straight. To this end, although the urging member is preferred as a wedge-shaped element, any other suitable biasing means may be utilised, and a single biasing means may be used to bias the movable arms towards their respective fixed members.

Furthermore, it has been described that the contact set utilises two opposing back-to-back groups of narrower and wider movable arms. However, other numbers and arrangements may be considered. For example, if the lead/lag switching procedure is not required, then the movable arms in each group may be of the same width and/or have the same size of movable contacts. Equally, if the lead/lag switching procedure is required, then a single wider and a single narrower movable arm may be provided in each group.

In the lead/lag switching arrangement, the switching lead arm which initiates the closed circuit carries the load current for a fraction of a second until the switching lag arm also closes. Consequently, the switching lead arm being wider is advantageous in normalising a thermal load in the arms. With the contacts all closed, all arms or blades and contacts share the total load current in parallel, thereby achieving a low resistance and low millivolt drop.

Furthermore, in the lead/lag switching arrangement, it is preferable that the wider second movable arm, previously being the switching lead arm during the closing procedure of the contacts, fractionally lags during an opening procedure with respect to the narrower first movable arms. The wider second movable arm therefore again carries the load current for a fraction of a second following the narrower first movable arms opening, thus reducing arcing between opening contacts associated with the narrower first movable arms and limiting a thermal shift in the arms.

Opposing or facing groups of wide and narrow movable arms should preferably face wide-to-wide and narrow-to-narrow across the partitioning element. This is beneficial in balancing the forces generated in each arm during a short circuit condition, due to the same repulsive forces being generated by the similar opposing currents.

In regards the single-phase electrical contactor for Live and Neutral feeds, it may also be preferable to utilise the lead/lag switching procedure. Switching the Neutral first and second terminal set fractionally prior to the Live first and second terminal set, arcing can be prevented or suppressed thereby improving the operational life of the movable electrical-contact set.

For balancing purposes and thermal stability, although it is preferred that both contact sets either side of the partitioning element operate in unison, with or without the lead/lag switching procedure, it is feasible that one side could utilise the lead/lag switching arrangement whilst the movable arms on the other side may all close together simultaneously or substantially simultaneously.

While all embodiments show wedge-shaped elements employed for biasing the movable arms, and thus the movable contacts, outwardly for closing the switches, any suitable outwards biasing means capable of performing the biasing or close switch function, for example strut or block elements and pegs or rollers acting on the inside faces of the shoulders of the movable arms, may be employed.

Generally alternative members for separating and/or urging the arms together would remain integral with the carriage attached to the solenoid plunger, the stroke and actuation geometry being chosen to achieve the correct open/close switch functions, as required. This is not, however, essential and actuating arrangements where the members acting directly on the movable arms are independently movable could be employed.

The member acting directly on the movable arms or blades may be moved by any convenient actuation device. Any suitable motive force may be applied, for example a carriage could be moved by an electric motor or by any suitable mechanical means including manually activated mechanical means such as a lever.

It is thus possible to provide an electrical contactor, and more particularly a two-pole two-terminal electrical contactor, which utilises back-to-back electrically-conductive movable arms and contra-flowing currents therein to harness an inherent repulsive magnetic force by which contact closure can be facilitated or augmented. Additionally, as an advantage over the prior art arrangement, the present invention provides for an electrical contactor having twelve contacts instead of sixteen, with the associated cost savings and benefits described above. Furthermore, by providing a plurality of aligned and opposing movable arms in back-to-back arrangement, current sharing can be realised, allowing a reduction in electrically conductive material to be utilised whilst also achieving a lower electrical resistance in each switch. Due to the numbers of movable arms in each group preferably being equal with matching corresponding lateral extents, the balancing of the contact set is simplified. It also possible to reduce a top-lay material thickness of a number of the movable contacts by configuring the associated movable arms, in this case preferably being narrower, to lag behind a leading movable arm, which may be wider, during a switch-closing process. By this lead/lag switching procedure, cleaner switching can be realised along with minimizing a millivolt drop and self-heating within the movable arms to an acceptable level, in addition to eradicating melt-pool tack-welding between contacts. By utilizing a distal end extension on each movable arm, it is also possible to impart a more controlled closing force to the contacts, whilst also preventing or limiting contact deflection. It is further possible to improve the seating of the movable contacts on their associated fixed contacts by the use of the distal end extensions being biased and braced by the urging member. A reduction in size of the movable arms also allows a smaller housing to be utilised, whilst utilizing one or more ferrite magnets in the electromagnetic actuator decreases costs and allows dual latching, where necessary.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

In the description and claims of the present application, each of the verbs "comprise", "include", "contain" and "have", and variations thereof, are used in an inclusive sense, to specify the presence of the stated item or feature but do not preclude the presence of additional items or features.

The embodiments described above are provided by way of example only, and various other modifications will be apparent to persons skilled in the field without departing from the scope of the invention as defined by the appended claims.

The invention claimed is:

1. An electrical contactor comprising a pair of first terminals, each having a fixed member with at least one fixed electrical contact facing the other said fixed member;

a pair of second terminals having back-to-back electrically-conductive movable arms with an electrically-insulating partitioning element therebetween to insulate the movable arms located respectively on the opposite sides of the partitioning element;

each second terminal being associated with a different one of the first terminals, and having a movable electrical contact on the associated movable arm which faces the corresponding fixed contact;

the arrangement of the fixed members and the movable arms being such that, when the contacts close, contra-flowing current through the back-to-back movable arms produces a repulsive force therebetween which urges the movable arms away from each other, thereby increasing a force between the fixed and movable contacts;

wherein each of two said movable arms, which are located on opposite sides of the partitioning element, comprises a first section proximal to said movable contact thereon and a second section distant from the same movable contact; both the first sections face each other and both the second sections face each other; and the repulsive force produced by and between both second sections is larger than the repulsive force produced by and between both first sections.

2. The contactor of claim 1, further comprising an actuating arrangement, wherein each movable arm includes a distal extension element extending distally of the movable contact and the actuating arrangement includes an urging member for outwardly biasing each distal extension element.

3. The contactor of claim 2, wherein each distal extension element is in-turned towards the partitioning element.

4. The contactor of claim 2, wherein the urging member includes a wedge-shaped element which is movable longitudinally of the movable arms and arranged to outwardly bias the distal extension elements so that the movable arms are urged towards the fixed members.

5. The contactor of claim 2, wherein the in use urging member counteracts inward distal rotation of the movable contacts due to the repulsive force which urges proximal portions of the movable arms away from each other when the contacts are closed.

6. The contactor of claim 2, wherein the actuating arrangement includes a separator member for separating the movable arms from their respective fixed members thereby opening the contacts.

7. The contactor of claim 6, wherein the separator member is movable from a first position at which it causes the contacts to open to a second position at which the movable arms are freely movable towards the fixed members.

8. The contactor of claim 7, wherein the separator member includes at least one elongate strut-like element proximally of the movable contacts.

9. The contactor of claim 6, wherein the actuating arrangement includes a carriage which is movable relative to the movable arms, the urging member and the separator member are disposed on the carriage whereby the movable contacts are interposed therebetween.

10. The contactor of claim 9, wherein the actuating arrangement further comprising a dual-latching electromagnetic actuator for moving the carriage to cause the contacts to close and open.

11. The contactor of claim 1, wherein each second terminal comprises at least two said movable arms at one side of the partitioning element aligned with at least two said movable arms at the other side of the partitioning element.

12. The contactor of claim 11, wherein the said at least two said movable arms comprise a narrow movable arm and a wide movable arm, the wide movable arm being pre-set to lead during closing of the contacts, and the narrow movable arm being pre-set to lag during closing of the contacts.

13. The contactor of claim 12, wherein the movable contact of the narrow movable arm is smaller than the movable contact of the wide movable arm.

14. The contactor of claim 1, wherein the contactor is a two-pole electrical contactor.

15. The contactor of claim 1, wherein the contactor is a single-phase electrical contactor for Live and Neutral feeds.

16. The contactor of claim 1, wherein the distance between both first sections facing each other is larger than the distance between both second sections facing each other.

17. The contactor of claim 16, wherein each movable arm comprising said first section and said second section further comprises a third section between the first section and the second section.

18. The contactor of claim 16, wherein both first sections are aligned with and parallel to each other, and both second sections are aligned with and parallel to each other.

19. The contactor of claim 1, wherein the actuating arrangement includes a separator member for separating the movable arms from their respective fixed members, thereby opening the contacts.

20. The contactor of claim 19, wherein the separator member is movable from a first position at which it causes the contacts to open to a second position at which the movable arms are freely movable towards the fixed members.

21. The contactor of claim 20, wherein the separator member includes at least one elongate strut-like element proximal to the movable contacts.

22. The contactor of claim 19, wherein the actuating arrangement includes a carriage which is movable relative to the movable arms, the separator member is disposed on the carriage, whereby the movable contacts are interposed therebetween.

* * * * *